United States Patent [19]

Gruen et al.

[11] Patent Number: 4,889,987

[45] Date of Patent: Dec. 26, 1989

[54] PHOTO ION SPECTROMETER

[75] Inventors: Dieter M. Gruen, Downers Grove; Charles E. Young, Westmont; Michael J. Pellin, Naperville, all of Ill.

[73] Assignee: ARCH Development Corporation, Chicago, Ill.

[21] Appl. No.: 14,332

[22] Filed: Feb. 13, 1987

Related U.S. Application Data

[63] Continuation-in-part of Ser. No. 870,437, Jun. 4, 1986.

[51] Int. Cl.[4] ..... H01J 49/40

[52] U.S. Cl. ..... 250/282; 250/287; 250/288; 250/423 P

[58] Field of Search ..... 250/281, 282, 283, 288, 250/423 P, 305, 287

[56] References Cited

U.S. PATENT DOCUMENTS

| | | | |
|---|---|---|---|
| 3,914,655 | 10/1975 | Dreyfus | 250/423 P |
| 4,209,697 | 6/1980 | Renner et al. | 250/423 P |
| 4,442,354 | 4/1984 | Hurst et al. | 250/423 P |
| 4,633,084 | 12/1986 | Gruen et al. | 250/423 P |
| 4,733,073 | 3/1988 | Becker | 250/423 P |

*Primary Examiner*—Bruce C. Anderson

*Attorney, Agent, or Firm*—Michael D. Rechtin; Philip P. Mann

[57] ABSTRACT

A charged particle spectrometer for performing ultra-sensitive quantitative analysis of selected atomic components removed from a sample. Significant improvements in performing energy and angular refocusing spectroscopy are accomplished by means of a two dimensional structure for generating predetermined electromagnetic field boundary conditions. Both resonance and non-resonance ionization of selected neutral atomic components allow accumulation of increased chemical information. A multiplexed operation between a SIMS mode and a neutral atomic component ionization mode with EARTOF analysis enables comparison of chemical information from secondary ions and neutral atomic components removed from the sample. An electronic system is described for switching high level signals, such as SIMS signals, directly to a transient recorder and through a charge amplifier to the transient recorder for a low level signal pulse counting mode, such as for a neutral atomic component ionization mode.

11 Claims, 10 Drawing Sheets

PHOTO ION SPECTROMETER

CONTRACTUAL ORIGIN OF THE INVENTION

The U.S. Government has rights in this invention pursuant to Contract No. W-31-109-ENG-38 between the U.S. Department of Energy and Argonne National Laboratory.

This is a continuation-in-part of Ser. No. 870,437, filed June 4, 1786.

BACKGROUND OF THE INVENTION

The present invention relates generally to a charged particle spectrometer. More particularly the invention relates to a spectrometer having a lens system configured to extract from a sample charged particle components having well controlled energy values and also to provide precise spatial manipulation and time of flight for the various charged particle beams, enabling highly sensitive detection of the charged particle components. Significant improvements in performing energy and angular refocusing spectroscopy are accomplished by using a two dimensional structure for generating predetermined electromagnetic field boundary conditions. The spectrometer is also operable in a number of modes including multiplexed SIMS and neutral atomic component ionization with time of flight analysis.

Significant advances have been made in the quantitative analysis of atomic components in a sample. For example, resonance ion spectrometers have demonstrated considerable sensitivity for the detection of atoms of a predetermined component. (See, for example, U.S. Pat. No. 4,442,354 and 3,987,302 (Hurst et al.) which are incorporated by reference herein). In practice, however, these previous resonance ion spectrometers still have significant limitations in terms of achieving reliable sensitivities in the part per trillion range because of severe difficulties encountered in discriminating low level signals to be measured from noise made up of competing, undesired and extraneous signals.

OBJECTS

It is therefore an object of the invention to provide an improved spectrometer for quantitative analysis of selected charged particle components.

It is a further object of the invention to provide an improved ion spectrometer for performing, selectively, multiplexed resonance ion, non-resonance ion and secondary ion mass spectrometry.

It is another object of the invention to provide a novel charged particle spectrometer wherein a predetermined electric field is applied to charged particles enabling improved detection sensitivity for selected atomic components removed from a sample.

It is an additional object of the invention to provide an improved spectrometer structure for generating precise electromagnetic field conditions for analysis of a charged particle beam.

It is another object of the invention to provide an improved spectrometer structure having electromagnetic field elements formed using dot matrices of selectable density film configurations.

It is an additional object of the invention to provide a film configuration disposed on a removable substrate, the film configuration adapted to provide predetermined electromagnetic field conditions.

It is a further object of the invention to provide an improved ion spectrometer adapted to generate selected atomic components from a sample for analysis using short period, pulsed laser irradiation of the sample.

It is another object of the invention to provide a mass spectrometer having an electronic data collection system with a transient recorder adapted to be switched between a secondary ion beam signal and a signal characteristic of ionized neutral atomic components from a sample.

A significant feature in accordance with the instant invention lies in the provision of an improved spectrometer having enhanced sensitivity for detecting selected atomic components of a sample. This enables analysis of extremely small quantities of sample. This enhanced sensitivity is achieved by performing resonance and non-resonance ionization of neutral atomic components removed from the sample and extracting the ionized atomic components for time of flight analysis. A lens system includes elements having field generating structures fabricated using dot matrices of selectable density. The dot matrices are disposed as a thin film on a substrate adapted for easy removal once the dot matrices are in place. The lens system further includes a variable shape, two dimensional thin film configuration for providing precise electromagnetic field boundary conditions for energy analysis of the charged particles. The lens system is also configured to provide a predetermined slowly diminishing electric field region for a volume containing a large portion of the ionized form of the charged particles. The slowly diminishing filed region minimizes the energy spread over the volume for the charged particles which are subsequently extracted for spectroscopic analysis, such as in an energy and angular refocusing time of flight ("EARTOF," hereinafter) spectrometer. The relatively small energy spread makes the spectroscopic analysis substantially more accurate and increases the signal to noise ratio.

In an additional aspect of the invention, the spectrometer is adapted to remove atomic components from a sample using an ultra short period laser beam pulse, and a subsequent laser beam pulse ionizes selected ones of the neutral atomic components for mass spectrometric analysis. In a further aspect of the invention, a spectrometer system is selectively operative in an interleaved mode wherein during one cycle secondary ions from a sample are analyzed in an EARTOF mode of a secondary ion mass spectrometer, and in a subsequent cycle neutral atomic components removed from the sample are ionized and analyzed in an EARTOF spectrometer.

Further objects and advantages of the present invention, together with the organization and manner of operation thereof, will become apparent from the following detailed descripton of the invention when taken in conjunction with the accompanying drawings wherein like reference numerals designate like elements in the several views.

BRIEF DESCRIPTON OF THE DRAWINGS

Figure 9:
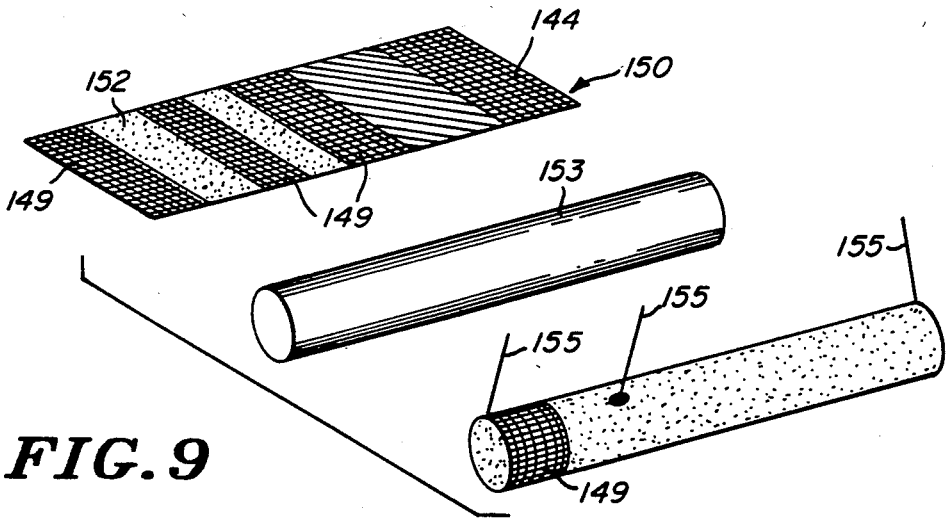
Figure 10A:
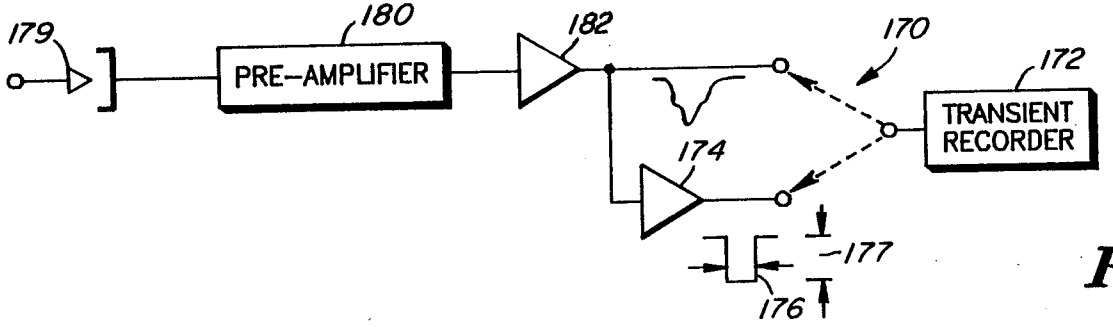

FIG. 9 illustrates a media including a substrate and thick film configuration for mounting in a preselected spatial location; and FIG. 10A is a block component diagram of a system for operating in two multiplexed spectroscopic modes: SIMS or other high level signal mode and a mode of resonance ionization of neutral atomic components with EARTOF spectrometry and 10B is a timing diagram for signal sampling by a transient recorder in the system of FIG. 10A.

DETAILED DESCRIPTION OF THE PREFERRED EMBODIMENT

Figure 1:
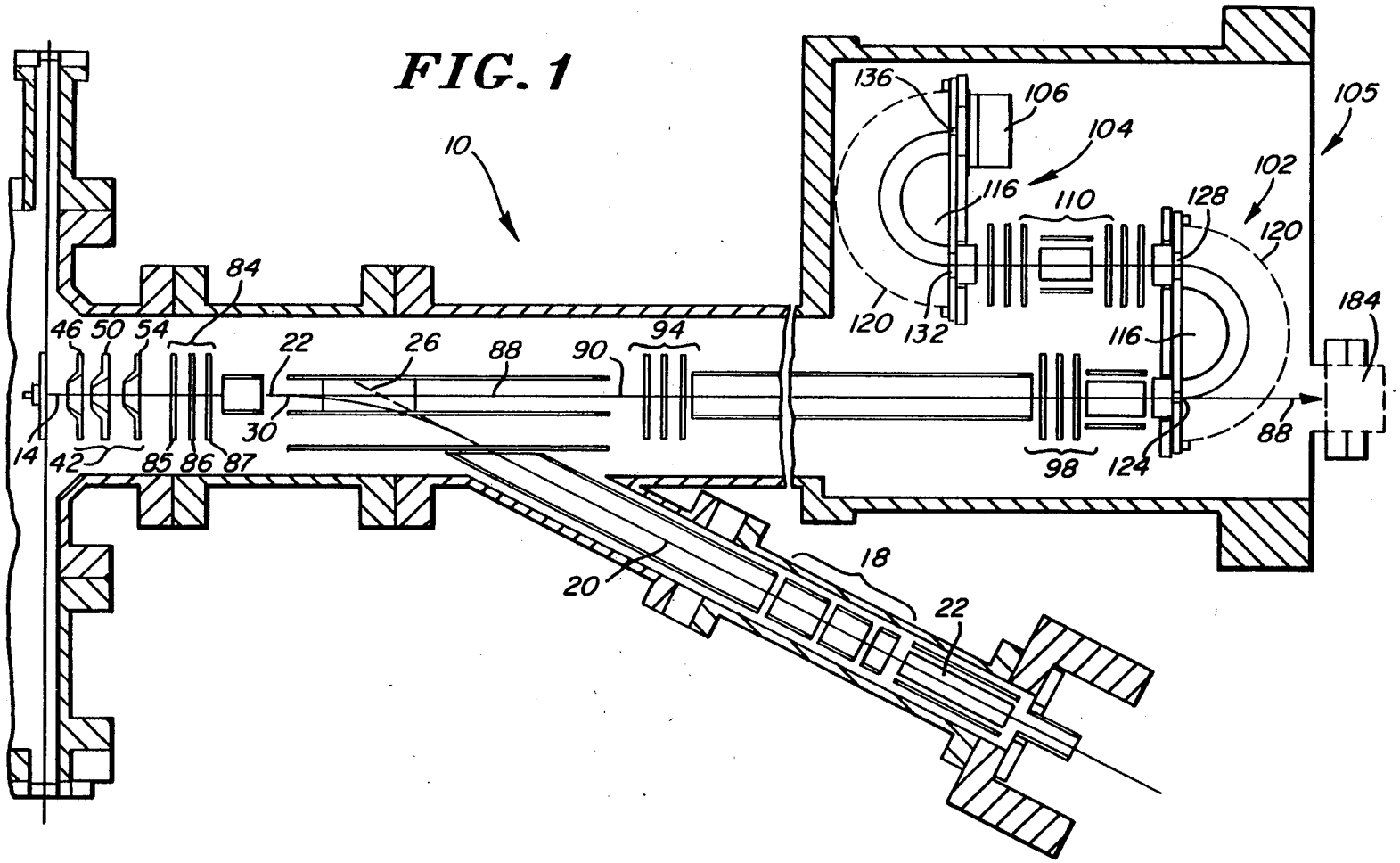
FIG. 1 illustrates an ion spectrometer constructed in accordance with one embodiment of the invention.
Figure 2:
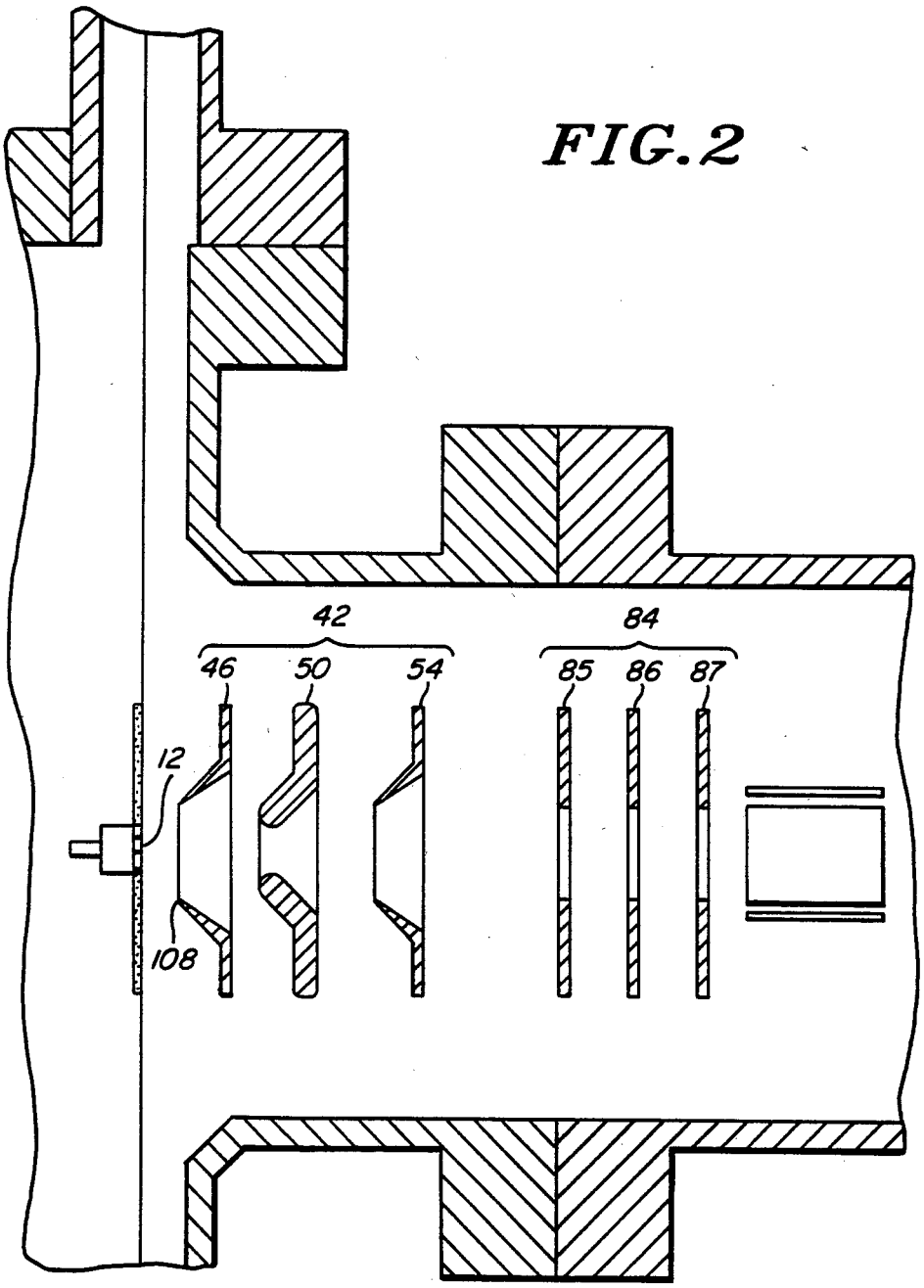
FIG. 2 shows a fragmentary view of the sample chamber and ion extraction region of the spectrometer of FIG. 1.
Figure 4:
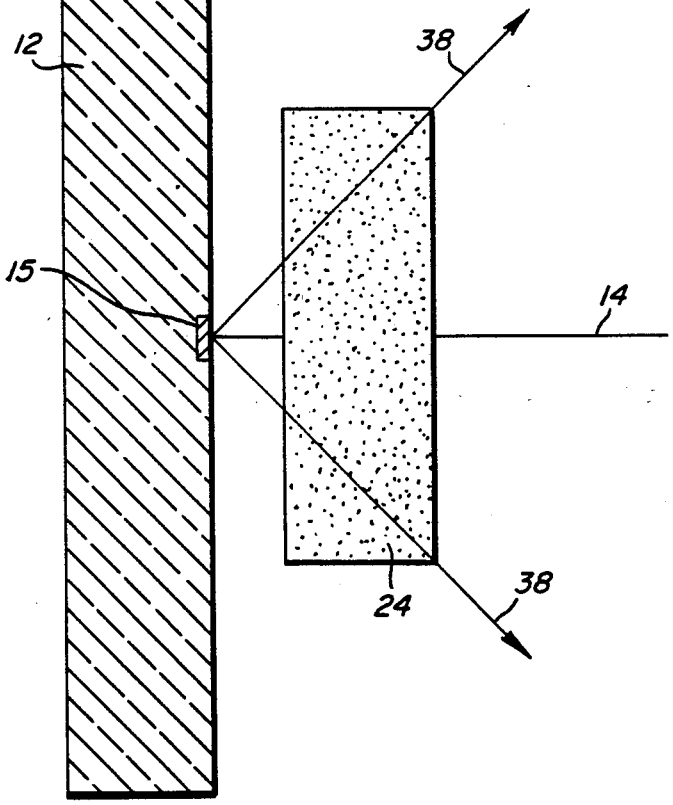
FIG. 4 is an enlarged fragmentary view of the sample area during generation of charged particles for analysis.
Figure 5:
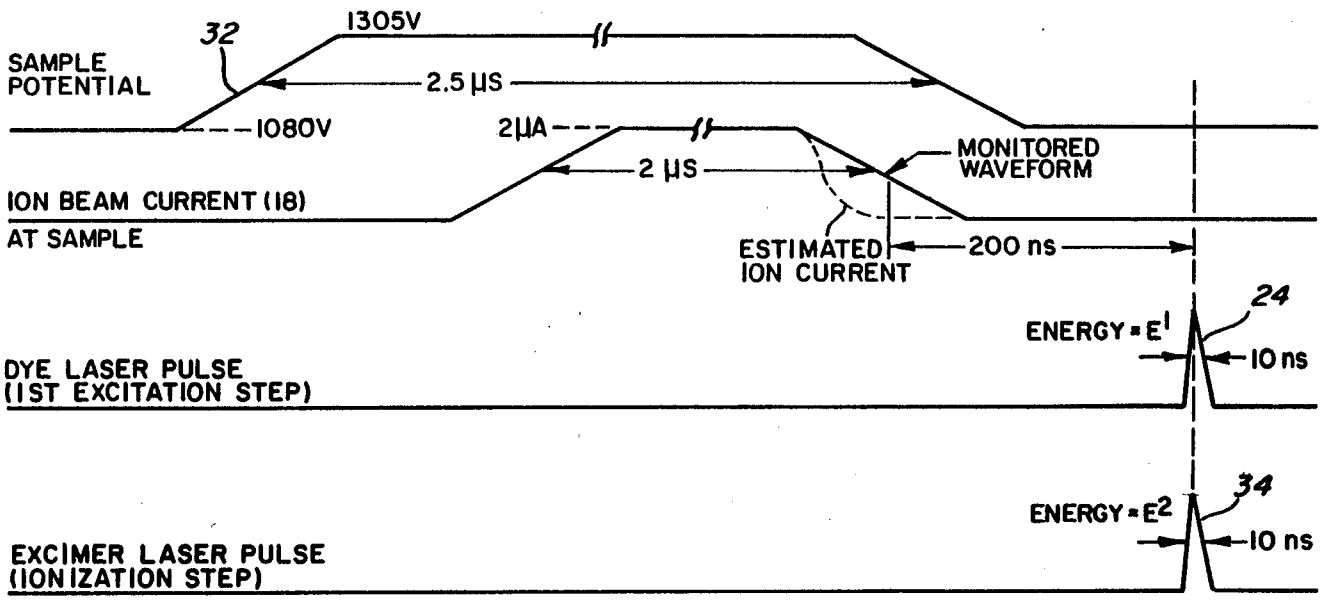
FIG. 5 illustrates a timing cycle for generation of an ionized beam of the selected atomic component.

Referring now to the drawings, and in particular to FIGS. 1 and 2, an improved ion spectrometer constructed in accordance with one embodiment of the present invention is indicated at 10. Very generally, the ion spectrometer 10 (hereinafter, the "spectrometer 10") includes a sample 12 disposed within a high vacuum (less than about $10^{-9}$ Torr) provided by a conventional ultra high vacuum pumping system (not shown). Measurement of the quantity of a selected atomic component from the sample 12 is carried out by removing atoms for subsequent quantitative analysis. In one form of the invention, the selected atomic component is removed from the sample 12 by irradiating the sample 12 with an energetic particle beam, such as an ionized particle beam 14 (hereinafter, "primary ion beam 14") in the illustrated embodiment. A substantial portion of the selected atomic component removed from the sample 12 originates from a sample region 15 shown in FIG. 4, where the flux is highest from the primary ion beam 14. Typically, inert gas ions are used as the primary ion beam 14 and have an energy of 5 kV. The primary ion beam 14 is preferably a pulsed beam (see FIG. 5). This pulsed beam allows cooperation with other physical events (some of which are shown in FIG. 5), enabling performance of various functionalities to be described hereinafter. The primary ion beam 14 is deflected by deflector plates 18 from a first path 20 to a second path 22, which intersects the sample 12 substantially perpendicular thereto. When the primary ion beam 14, or other such energetic beam, strikes the sample 12, various atoms, including the selected atomic component, are ejected from the sample 12. In preparation for spectrometric analysis a volume containing a number of atoms of the selected atomic component is therefore generated near the sample 12.

In other forms of the invention the energetic particle beam can be other types of beams, such as, for example, a neutral particle beam, an electron beam, fission fragments or a photon beam, such as a laser beam. As shown in FIG. 4, a laser beam 24 can be used for bombardment of the sample 12 for a preselected short time period, generating a volume near the sample 12 containing the selected neutral atomic component. The short time period is chosen to substantially avoid further excitation by the laser beam 24 of the selected atomic components generated in the volume near the sample 12. This permissible time period varies depending on the velocity and mass of the absorbing atomic components. Subsequently, at least one pulse of a radiation beam, such as a second laser beam 34, is applied to the volume containing the neutral atomic component in order to ionize the atomic component. These ionized atomic components are then extracted for the selected spectrometric analysis. The use of the laser beam 24 to bombard the sample 12 allows removal of the selected atomic component from all varieties of material, including non-conductive insulators which incur charge buildup problems if ion beams are used for removing atomic components.

At typical energy thresholds for laser ablation of selected atomic components from the sample 12, there can be sufficient laser beam flux to excite the selected atomic components to a plasma state. The concentration of selected ions in the plasma will tend to be a complex function of the collision processes occurring during laser ionization of the neutral atomic components. Under these conditions, controlled and well characterized ionization of the selected neutral atomic components becomes extremely difficult to achieve, thus causing uncertainties in the subsequent spectrometric analysis. However, these difficulties can be overcome by applying extremely short period laser beam pulses, such as one to twenty picosecond pulses. Plasma formation can be avoided, enabling controlled removal of the atomic component and well characterized ionization of selected neutral atomic components.

There are certain other advantages attendant to the use of short period laser beam ablation of the selected atomic components. These advantages include the formation of a subtantially narrower energy spread for the removed neutral atomic components compared to the energy spread when the atomic components are sputtered or are removed by long period laser beam pulses. The narrower energy spread allows improved mass resolution and/or collection efficiency for the selected atomic components. Another advantage for the extremely short time period laser pulses is a very thin layer of the sample is melted. Typically the melt layer thickness is about 10 nm, thereby avoiding substantial material redistribution and alteration of compositional makeup of the sample 12. These conditions allow good depth resolution during depth profiling of the sample 12.

Use of laser ablation methods to remove the selected atomic components also enables a high spatial resolution laterally on the surface of the sample 12, with the lateral resolution limited primarily by the diffraction limit of light. Near the melting point threshold, however, better spatial resolution is achievable by virtue of ejection of the selected atomic component from a preferentially hot region on the sample 12 located at the center of the laser beam 24. Such additional spatial resolution control is achieved through careful control of laser beam power for conditions causing the surface to be near the melting point threshold.

In cases where the sample 12 has a highly conducting surface (intrinsically conductive or induced by the laser beam 24) electromagnetic mechanisms associated with the laser beam 24 can be used advantageously to reduce plasma formation. For predetermined orientations of incidence for the laser beam 24 relative to the sample surface and laser beam polarization direction, the laser beam electric field is strongly attenuated near the surface of the sample 12. For example, during a ten picosecond laser beam pulse, the selected atomic components having thermal energy will propagate roughly 10 nm or less, which is much less than the wavelength of the laser beam 24, and leads to greatly diminished ionization probability.

In order to remove unwanted ions from the volume containing the selected neutral atomic component or to place ions at high energies leading to escape trajectories out of the spectrometer 10, a positive electric field potential 32 is generated on the sample 12. As shown in FIG. 5, the positive electric field potential 32 on the sample 12 is pulsed from about +1080 to +1350 volts prior to the arrival of the 5 kV pulsed primary ion beam 14 at the sample 12. The electric field potential 32 is maintained throughout the period that atoms are removed from the sample 12. Thus, the positive electric field potential 32 acts to: (1) remove stray ions present before the sputtering or ablation of atoms (or ejection of the atoms by other means) from the sample 12, and also (2) to remove any secondary ions present as a consequence of the sample irradiation by the primary ion beam 14 (or the laser beam 24).

After removal of the unwanted ions from near the sample 12, the volume near the sample 12 contains as a residual, various neutral forms of the selected neutral atomic components which the operator desires to detect. These selected atomic components are, for example, single atoms and/or molecules. As shown in the view of FIG. 4, the volume containing a large portion of the selected neutral atomic components near the sample 12 is irradiated to generate photo ions. In the illustrated embodiment (see FIGS. 4 and 5) the irradiation is performed by a laser beam pulse 34 which is shown in an end view cross section in FIG. 4. As shown in FIG. 5 the laser beam pulse 34 is timed subsequent to the removal of unwanted ions from near the sample 12. As also noted in FIG. 5 the laser beam pulse 34 can comprise more than one pulse of different laser wavelength, corresponding to energies $E_1$ and $E_2$, and this aspect of the invention will be described in more detail below. A perimeter 38 of a 45° conical volume is illustrated in FIG. 4, and the conical volume encompasses roughly one half of the ions ejected from the sample region 15 of the sample 12, assuming a cosine type angular distribution of the ions relative to the axis defined by the beam path 30 for the primary ion beam 14. The laser beam pulse 34 is therefore positioned with respect to this distribution to excite the maximum possible percentage of the neutral selected atomic components ejected from the sample 12.

Creation of the ionized form of the selected neutral atomic components is an important early step toward the objective of isolating the desired signal from unwanted noise and extraneous signals measured during the final quantitative analysis. Therefore, sensitive analysis is commenced by the laser beam pulse 34 ionizing the selected neutral atomic components to energies above the ionization potential (see FIG. 5). In one form of the invention, significant further separation of the desired signal is achievable using two laser wavelength, corresponding photon to energies, $E_1$ and $E_2$, mentioned above with the first laser beam pulse 34 having an energy $E_1$ to selectively excite the selected atomic component to an energy below the ionization level. While not having sufficient energy to ionize other atomic components not previously excited, the second form of the laser beam pulse 34 has the energy $E_2$ which ionizes the previously excited atomic component.

One form of excitation for $E_2$ is, for example, non-resonance excitation to the ionization continuum. Because the second laser energy at $E_2$ is not in energy resonance between an initial energy state and a final discrete state of the excited atomic component to be ionized, the cross section for the process is small; consequently, the power density required to saturate the ionization process is usually quite large. The required power can be achieved with large fixed-frequency lasers, but the drawback is that multiphoton non-resonance ionization of various unwanted species can become important. Although the multiphoton non-resonance ionization process may still have low probability relative to the single photon non-resonance ionization of the previously excited selected atomic component of interest, significant background ionization may still occur because of the much greater abundance of the majority species (e.g., atomic species of the matrix of the sample 12) in the ionization volume irradiated by the laser pulse 34.

A useful alternative for the second ionization step at energy $E_2$ involves the application of specific wavelengths chosen to connect the excited atomic level produced by irradiation from the first laser beam pulse 34 having energy $E_1$ to an autoionizing level of the selected atom component. States of the autoionization type are also conventionally called "discrete states embedded in the continuum", and have the property of rapidly decaying to an ion plus a free electron. Nevertheless, cross sections for excitation to these autoionization states are much larger than those for non-resonance ionization. Consequently, saturation of the second excitation step with energy $E_2$ is possible with the use of much less power density. This reduces the probability of ionizing majority unwanted species via multiphoton non-resonance ionization processes. It should be noted that in other forms of the invention one can use three or more laser beam pulses of selected energy.

Alternative modes of laser induced ionization offer other features for performing analysis of the selected atomic component in the sample 12. In cases where the extreme sensitivity of resonance ionizaiton (discussed above) is not required, or other chemical information is sought, multiphoton non-resonance ionizaiton offers some advantages. Multiphoton non-resonance ionization refers to a physical process where more than one photon is absorbed by an atomic or molecular species, will all the photons being absorbed in a single step. To achieve the desired power levels, conventional focused, high power, non-tunable lasers are typically employed. Some of the advantages of operating in a multiphoton non-resonance ionization mode are:

(1) A rapid survey of possible impurity species of the selected atomic component in the sample 12 can be performed. Since ionization occurs without the necessity of tuning to energy resonances of each species individually of the selected neutral atomic component, ion signals from neutral precursors of all elements present are obtained upon each occurrence of the laser pulse 34. Separation by mass is performable by a time of flight mass spectrometer alone.

(2) A quantitative comparison of relative impurity abundances can be obtained immediately. The ion-production step is a laser-based, multiphoton ionizaiton of gas phase species released from the sample. Variation of ionization probability from one atomic species to another can be minimized and calibrated. Dependence on the chemical environment in the sample 12 is small since the process of sputtering material depends essentially on simple momentum-transfer considerations. In contrast, in other types of ion spectroscopy, such as secondary ion mass spectrometry (hereinafter, "SIMS"), the ionization step itself occurs at the sample 12; and the ion production probability depends strongly on the chemical environment in the sample 12. Thus, quantitative SIMS is notoriously difficult to carry out. However additional useful quantitative measurements can be obtained using SIMS interleaved with ionization of neutral atomic components and EARTOF spectrometry as set forth hereinafter.

(3) Molecular species can be detected. Compared with atomic species, molecular species released from the sample 12 are distributed among a relatively large number of energy levels. This distribution dilutes the population in any one state and is initially unknown. The task of studying each level with tuned resonance ionization is prohibitive. However, with non-resonance ionization, all these initial levels are ionized together. The occurrence of many intermediate near resonances in the molecular cases facilitates the achievement of high ionization probability.

Figure 8:
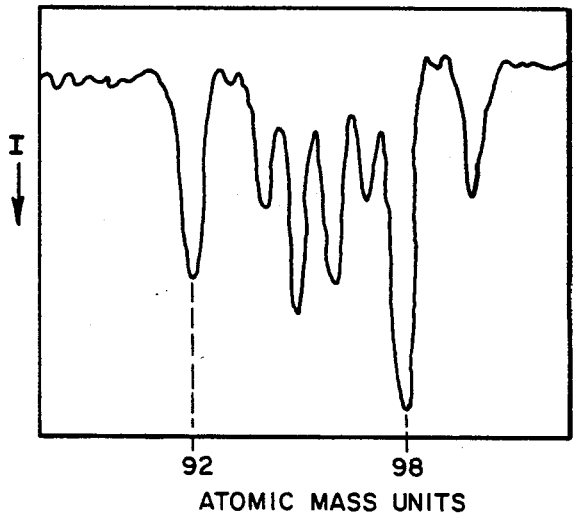
FIG. 8 is a mass spectral output for an EARTOF spectrometer operating in a neutral atomic component non-resonance ionization mode.

In some forms of the invention both resonance and non-resonance ionization are utilized to evaluate chemical parameters of interest. With the sensitivity of the ion spectrometer 10, the non-resonance and resonance modes can be interleaved, or multiplexed, providing extensive additional information which amounts to more than the sum of the individual sets of information. In the non-resonance mode typically only one pulse of the primary ion beam 14 produces a complete spectral output, enabling accurate quantitive analysis of the overall composition of the probed layer of the sample 12 (see Example II and FIG. 8).

Figure 3:
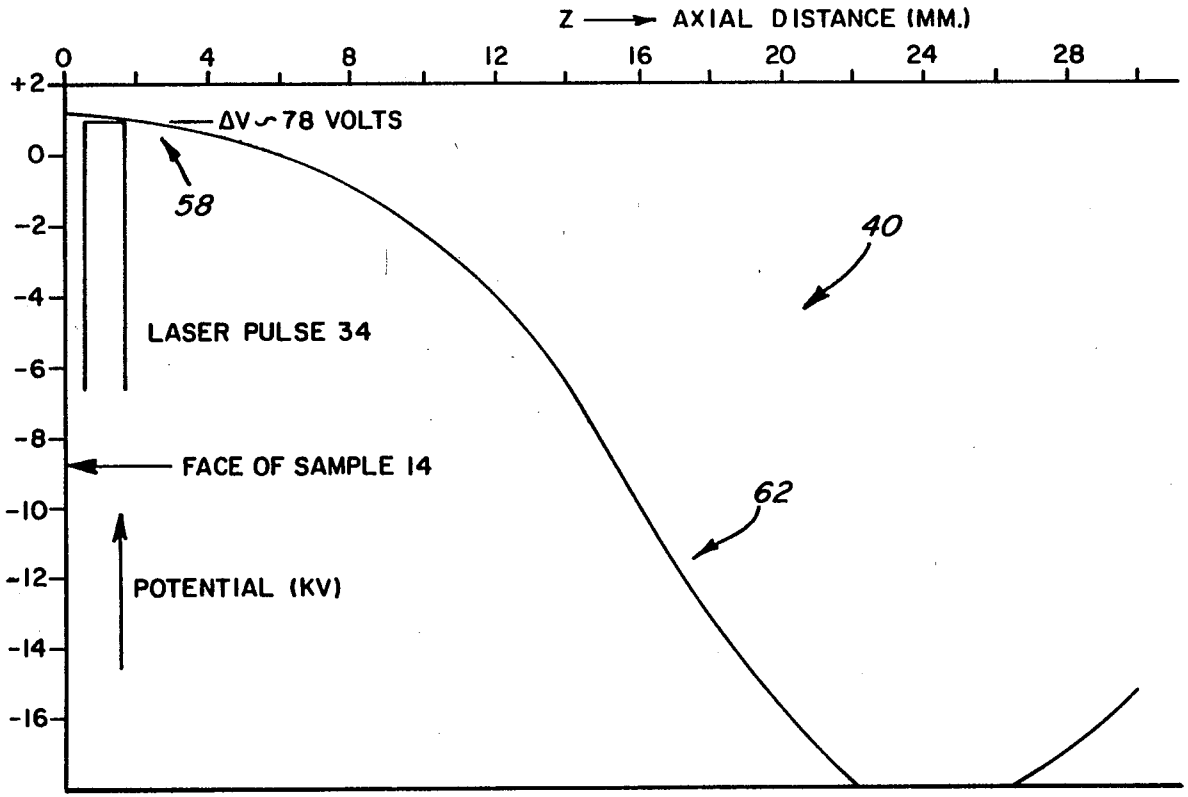
FIG. 3 illustrates a predetermined electric field as a function of perpendicular distance from the sample area shown in FIG. 2.

After generation of the ions of the selected neutral atomic component, the ions undergo an extraction process which assists in improving the signal to noise ratio in the subsequent quantitative spectroscopic analysis. A predetermined electrical field 40 shown generally in FIG. 3, is generated by combining the electric field potential on the sample 12 with an electric field generated by electric field means, such as an extraction objective lens 42 having active lens elements 46, 50 and 54 (see FIG. 2). For example, in a preferred embodiment the electrical field potential on the sample 12 is +1080 volts, and the potentials on the lens elements 46, 50 and 54 are +2300, −21,000 and −500 volts, respectivley. The resulting predetermined electric field near the sample 12 has a potential of about +1080 volts at the sample 12 and a slowly diminishing field region 58 extending from the sample 12 over a preselected portion of the volume adjacent to the sample 12. The slowly diminishing electrical field derives primarily from the field penetration of the highly negative potential of the lens element 50. The field potential over the width of the cross section of the laser beam pulse 34 shown in FIG. 3, is about 78 volts but can be readily modified by manipulating the various potentials on the sample 12 and the lens elements 46, 50 and 54.

The final ions generated from the neutral atomic components within the slowly diminishing field region 58 have a relatively narrow spread of electric potential across the volume, enabling more complete transmission and improved accuracy of energy analysis of the ions in the step of quantitative EARTOF analysis. At the same time, the high negative potential on the lens element 50 also enables the efficient collection of the ions and leads to improved signal to noise ratio. The use of a high negative potential on the lens element 50 has further advantages associated with ion beam focusing. This latter feature will be discussed in more detail hereinafter.

Contiguous to the slowly diminishing field region 58 and extending along particular directions substantially outside the volume and away from the sample 12 is a rapidly diminishing field region 62 shown in FIG. 3. This strongly negative field region acts on the ions entering this region 62 and begins the ion extraction process. As mentioned above, the strong negative field helps increase the photo ion collection efficiency and improves consequent signal to noise ratio. Extraction of the photo ions is accomplished by an extraction lens system, which comprises the extraction objective lens 42 discussed hereinabove and a collimator lens system 84, having elements 85, 86 and 87.

During operation of the spectrometer 10, contaminants are deposited on surfaces near the sample 12, and can result in the generation of unwanted ions and consequent detection of unwanted signals. These unwanted signals typically arise from deposition of material on portions of the extraction objective lens 42 and redeposition on the sample 12 as a contaminant, which is uncharacteristic of the true sample chemistry. These unwanted signals can be reduced by minimizing deposition of material on the nearby lens elements 46, 50 and 54 of the extraction objective lens 42. This minimization of material deposition is accomplished by forming one or more of the lens elements 46, 50 and 54 into appropriately shaped structures. For example, as best shown in FIGS. 1 and 2 the lens elements 46, 50 and 54, comprise truncated conical structures, minimizing the surface area exposed to the flux of particles emanating from the area including the sample 12. In particular, the lens element 46 nearest the sample 12 has a leading knife edge 108 for the conical structure, which further reduces the surface area exposed to the particle flux from the area, including the sample 12. The thicker structure used for the lens element 50 is designed to reduce the secondary electron emission which can arise from operation at a high negative electric field potential. However, since the redeposition problem rapidly diminishes with distance from the sample 12, any redeposition problem associated with the lens element 50 is much less than associated with the closer lens element 46.

The redeposition problem is further minimized by control of the electric field potential applied to the extraction objective lens 42. In the illustrated embodiment the electric field potential applied to the lens element 46 nearest the sample 12 is higher than the electric field potential on the smaple 12, as opposed to the previously mentioned secondary ion mass spectrometer (SIMS), wherein the electric field potential is strongly negative with respect ot the sample 12. The result is the flux of contaminant ions able to reach the lens element 46 is substantially limited in the present invention.

The extraction objective lens 42 and the collimator lens system 84 cooperate to extract neutral atomic components, which have been ionized by the laser beam pulse 34. The elements 85, 86 and 87 of the collimator lens system 84 comprises a set of conventional aperture einzel lenses. The extraction objective lens 42 and the collimator lens system 84 act to transform the trajectory pattern of the selected atomic component ejected from the sample 12 into a highly collimated ion beam 88 (hereinafter, the "ion beam 88") traveling along a third path 90. Thus, the extraction objective lenses 42 and 84 not only function to focus the primary ion beam 14 onto the sample 12, but also operate to extract the photo ions and provide the necessary collimation for subsequent quantitative EARTOF analysis. Lens element systems 94 and 98 provide additional focusing of the ion beam 88 prior to input to energy analyzer means, such as electrostatic analyzers 102 and 104 shown in FIGS. 1 and 6.

The EARTOF quantitative analysis of the illustrated embodiment is performed in a spectrometer detector region 105 using the electrostatic analyzers 102 and 104 as the analyzer section and an associated telescopic lens 110. The construction of this portion of the spectrometer 10 allows the reduction of the spread in time-of-flight for the ions undergoing analysis and includes structural features which attenuate various sources of noise, with both features leading to improved detection sensitivity. Another important feature is the use of complementary, 180° sections for the electrostatic analyzers 102 and 104 which provides a significant angular refocusing feature. Thus, for those ions having an angular deviation from perpendicularity with respect to the entry window plane of the electrostatic analyzer 102, the impact point at the exit window plane occurs very close to that of an ideal orbit. As a consequence, quite small entry window sizes can be utilized for the first 180° section (the electrostatic analyzer 102) and results in a sharp focal point 139 for analyzing the ion beam 88 in the second complementary 180° section, the electrostatic analyzer 104. Consequently, an improved attendant energy resolution results for the EARTOF analysis, and these features give rise to the energy and angular refocusing properties of the illustrated EARTOF mass spectrometer. Therefore, a selected range of energies and angles of entry in the detector regiono 105 arise by virtue of: (1) the method used to generate the atomic components from the sample 12 and (2 ) the use of the electromagnetic lens system of the ion spectrometer 10. The energy analysis and angular refocusing features are balanced in the spectrometer 10 to provide energy and angular refocusing which results in the different atomic components coming to a time and spatial focus at the detector plane. This feature allows highly efficient collection of signal for ultrasensitive specrtroscopy.

The electrostatic analyzers 102 and 104 include means for providing predetermined electromagnetic field boundary conditions. In a preferred embodiment the boundary condition means is more particularly resistive disk means, such as a flat resistive disk boundary plate 112 (hereinafter, "resistive plate 112") shown in a plan view in FIG. 7. The resistive plate 112 is disposed between an inner conducting hemisphere 116 and an outer conductor 120 (see FIG. 1). The hemisphere 116 and the outer conductor 120 comprise one example of means for applying a basic electromagnetic field, such as the electric field described herein. Details of structure and function of the resistive plate 112 and its method of manufacture will be discussed hereinafter.

The basic electromagnetic field (electric or magnetic) combines with the electromagnetic boundary field fashioned by the resistive plate 112 to generate a corrected electromagnetic field when electrical power is applied to the resistive plate 112. In the preferred embodiment, the outer conductor 120 is a conducting hemisphere shape; but in another form of this invention the outer conductor 120 can be a metallic band about the circular perimeter of the resistive plate 112. For the hemisphere form of the outer conductor 120, the hemisphere is preferably constructed of a highly transparent metal mesh. The open nature of the metal mesh minimizes the probability that ions which are uncharacteristic of the selected atomic component and which have escape trajectories leading out of the electrostatic analyzers 102 and 104 will be detected by a detector 106.

The ion beam 88 is input to the electrostatic analyzer 102 through a first entry window 124 which can be relatively narrow as discussed hereinbefore. A point focus of the ion beam 88 can be used advantageously to provide good energy resolution, thus minimizing energy variations resulting from the ions entering the electrostatic field off center. In addition this feature minimizes electric field fringe distortions whose magnitude is approximately proportional to the size of the opening of the entry window 124. In a similar manner a second exit window 136 of the electrostatic analyzer 104 has a relatively narrow opening, which gives rise to the same types of advantages attendant the narrow opening of the first entry window 124. The electrostatic analyzers 102 and 104 both have relatively large radial gaps between the inner conducting hemisphere 116 and the outer conductor 120. This relatively large radial gap accommodates a large range of charged particle energies within the energy analysis bandpass of the electrostatic analyzers 102 and 104, thereby improving the total collected signal and the signal to noise ratio.

A first exit window 128 and a second entry window 132 (see FIGS. 1 and 6A) both have relatively wide openings to accommodate the angularly divergent ions having different energies associated therewith. The electric field equipotentials near the various windows are, however, substantially ideal as a consequence of using the resistive plate 112 (see FIGS. 6A and 7), which provides predetermined electric field boundary conditions to achieve the required corrected electric field potential. Structural details and a method of preparation of the resistive plate 112 will be discussed hereinafter.

Figure 6A:
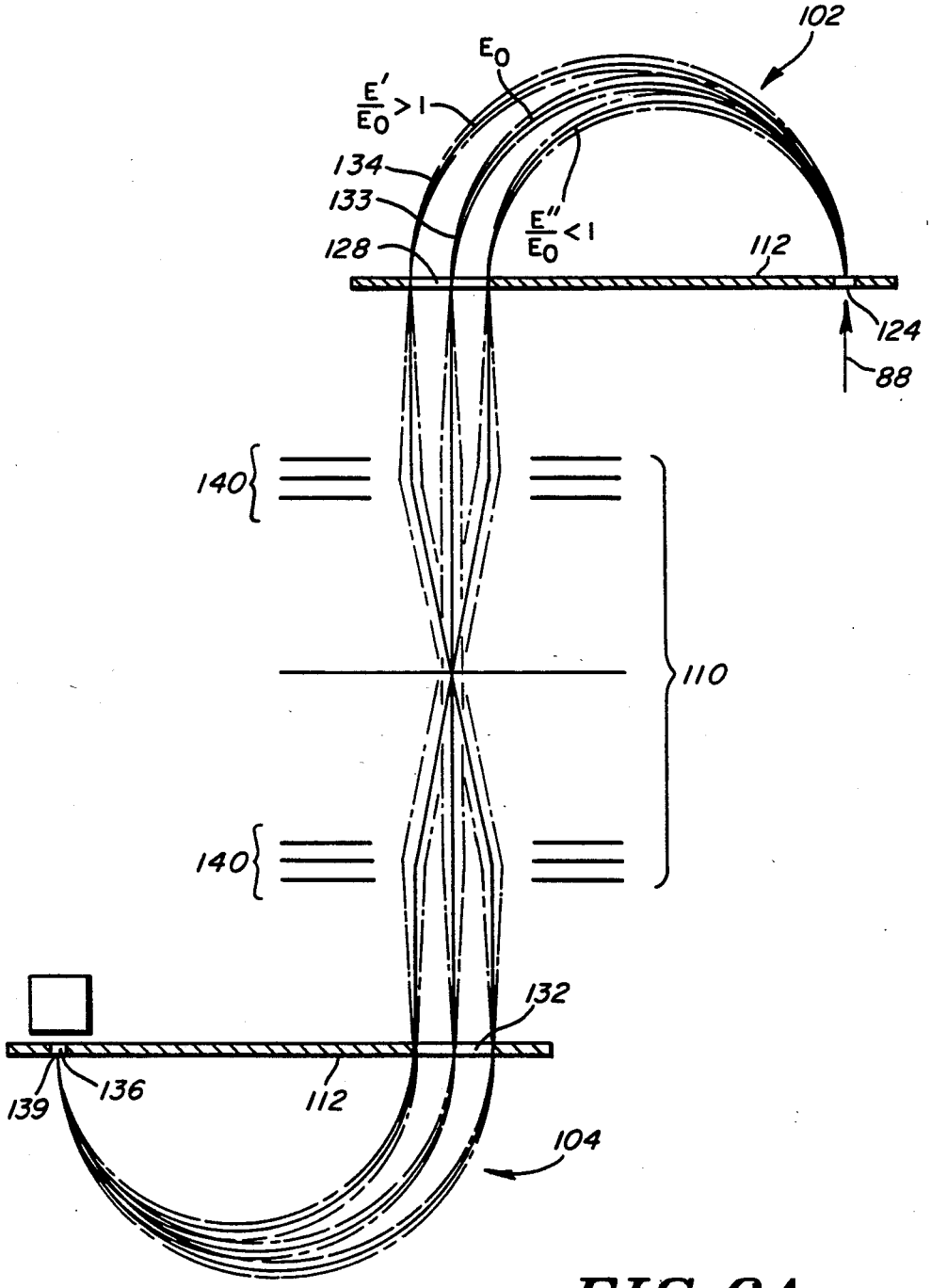
FIG. 6A depicts the orbits in the electrostatic analyzer of ions having various energies and FIG. 6B illustrates the orbits of ions entering at different angles with the same energy.
Figure 6B:
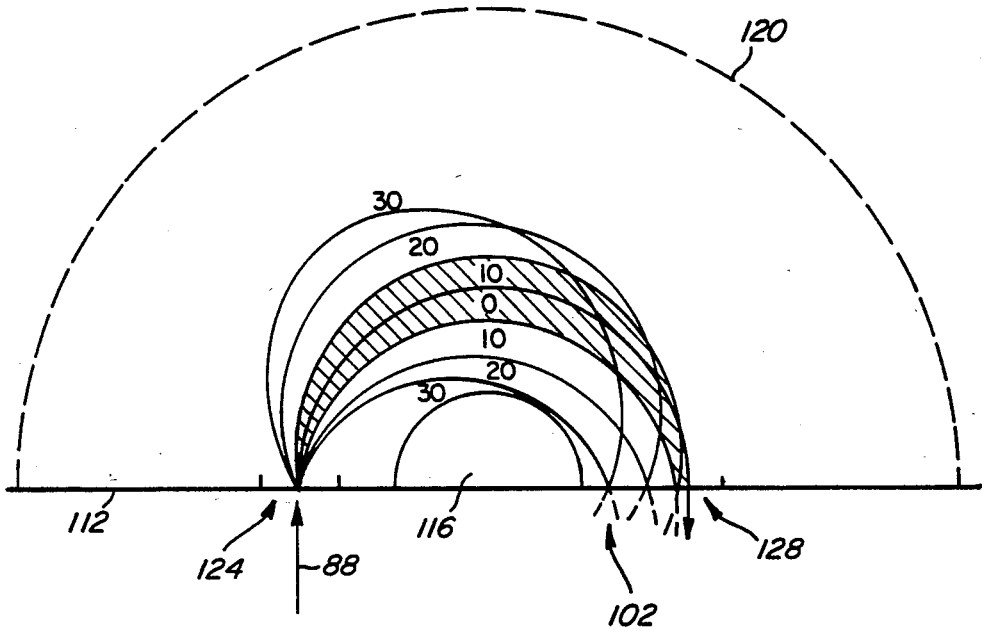

The orbits of the ions vary with kinetic energy, and for a particular electric field potential and kinetic energy, $E_0$, a circular orbit 133 is defined (see FIG. 6A). Therefore, for those ions having larger kinetic energy $E'$, such that $E'/E_0>1$, an orbit 134 is elliptical and has a larger arc terminating on the outer edge of the first exit window 128. Likewise for $E''/E_0<1$, a smaller arc terminates on the inner edge of the first exit window 128. If the orbits of the ions were allowed to complete a 360° arc, the known properties of trajectories in a 1/r electric field potential would indicate the return of the ion to the same starting point for ion energies below the energy escape values.

Furthermore, the time to complete one orbit for ions having substantially the same energy, but entering the electrostatic analyzer 102 with an angular deviation from the perpendicular to the plane of the first entry window 124, is weakly dependent on the angle of deviation for small angles of deviation. For the 180° spherical electrostatic analyzer 102, there is a focus at the plane of the exit window 128 and beyond that plane, the particle orbits diverge in the manner illustrated in FIG. 6B. Also, note the ions having orbits deviating from the perpendicular to the plane do not pass through the plane of the exit window 128 at the center of the exit window 128, but rather pass inside the center. However, as sen in FIG. 6A, this result is avoided in the electrostatic analyzers 102 and 104 by including the telescopic refocusing lens system 110 (hereinafter "lens system 110") and accomplishes a refocus at the end of the ion orbit at the focus point 139 in FIG. 6A, as discussed hereinbefore. The components of the lens system 110 include two electrostatic lens sets 140, which are identical to one another in the preferred embodiment. More particularly each of the lens sets 140 are aperture Einzel-lenses utilizing central elements at negative electric field potential.

The resistive plate 112, together with the inner conducting hemisphere 116 and the outer 120 conductor which generate the basic electric field, performs the function of a spherical electrostatic prism which includes predetermined electric field boundary conditions to achieve the stringent corrected, electric field potential which is required for the electrostatic analyzers 102 and 104 of the analyzer section. In order to maintain precise control of the high energy (kV level) ions and thereby isolate the desired signal from unwanted signals and noise, kV level voltages are usually applied across the resistive plate 112 to achieve the desired deflecting forces. The resistive plate 112 is also operated in a vacuum, and to maintain this vacuum the material should exhibit low vapor pressure, even when heat is generated during use. The resistive plate 112 also should be able to readily dissipate heat generated in order to avoid significant dimensional changes and possible material failure. These operating features make difficult the manufacture of the resistive plate 112 from bulk materials of the appropriate high resistivity.

Figure 7:
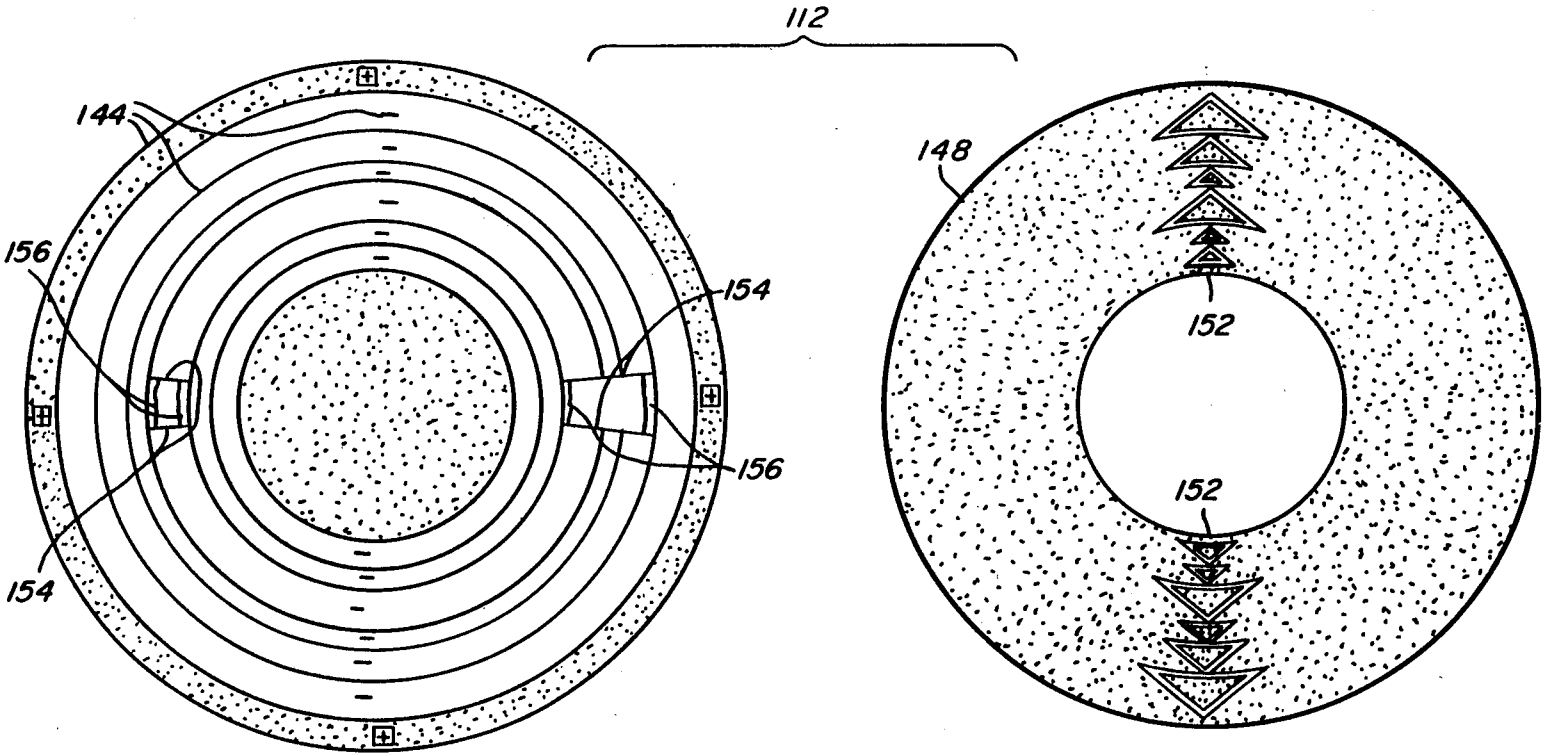
FIG. 7 shows a plan view of the components of a preselected thick film configuration on an insulator substrate.

In the embodiment illustrated in FIG. 7, the resistive plate 112 comprises an insulator substrate 144, such as a machinable glass ceramic of very high resistivity. Disposed on the insulator substrate 144 is a preselected thick film configuration 148 having selected electrical resistivity characteristics enabling generation of the previously mentioned predetermined electric field boundary conditions, responsive to an electrical current applied to the preselected thick film configuration 148. The resistive plate 112 therefore serves to provide substantially ideal predetermined electric field boundary conditions between the inner conducting hemisphere 116 and the outer conductor 120 of the electrostatic analyzers 102 and 104.

In the most general sense, the preselected thick film configuration 148 is a structure having a shape variable in two dimensions for generating predetermined electromagnetic field boundary conditions responsive to an electrical power applied to the thick film configuration 148. In the preferred embodiment the manufacture of the resistive plate 112 involves deposition of resistive thick films ("thick" defined as greater than 10 microns thick) using screen printing methods. In this preferred embodiment the resistive thick film is derived from an oxide paste, such as a bismuth-ruthenium oxide based material manufactured under the trade name of "BIROX" by Du Pont Corp. The thickness of the film is governed by the material properties, and it is contemplated that selected materials will enable use of thin films hundreds of Angstroms to several microns in thickness. In the preferred embodiment the oxide paste is applied to the insulator substrate 144 thorugh a prepared mask screen (not shown). The screen printing method enables deposition of thick films with complex spatial patterns to accommodate the desired predetermined electric field boundary conditions. Metallic pastes are also applied to the insulator substrate 144 to establish an electrode contact for applying electric current to the resistive portion of the preselected thick film configuration 148.

To achieve the predetermined electric field boundary conditions, given the shapes of the entry windows 124 and 132 and the exit windows 128 and 136 for the electrostatic analyzers 102 and 104, respectively, the fabrication steps are: (1) prepare the correct shape and size of the insulator substrate 144 suitable for depositing the thick films theron, (2) apply a thin conducting Ag/Pd based paste 156 (shown as dark areas on the left plan view of FIG. 7) to the insulator substrate 144, (3) firing the insulator substrate 144 at a temperature appropriate to achieve the desired electrical and mechanical properties, typically a temperature of about 800° C. with the conductive thick film configuration applied from step two above, (4) applying through the mask screen a resistive oxide paste (such as BIROX) to form an annular and spherical triangle configuration 152 shown in FIG. 7; also a thin layer 154 of the resistive oxide paste is applied to the upper and lower surfaces of the entry windows 124 and 132 and the exit windows 128 and 136, and (5) firing the assembly to form the final, fixed high electrical resistivity for the preselected thick film configuration 148. The design of the preselected thick film configuration 148 is based on the geometry of the electrostatic analyzer 102 or 104, including the shape and size of the various windows. Calculation of the desired two dimensional form of the preselected thick film configuration 148 is achievable using specialized mathematical analysis developed for this purpose.

In another form of the invention, the preselected thick film configuration 148 can be constructed using a plurality of dots having a predetermined number density and dot size and with an associated characteristic electrical resistivity. The material used can be the above described bismuth-ruthenium oxide based material or other suitable material to achieve the desired resistivity.

In a different form of a invention the preselected thick film configuration 149 can be deposited on a substrate, such as a decal 152 (see FIG. 9). The decal 152 and the thick film configuration 149 as a combination media 150 can then be positioned in a preselected spatial location, such as on a quadrupole mass filter rod 153 (see FIG. 9) or cylinder (not shown) of a cylindrical analyzer of a spectrometer lens. The decal 152 has a material makeup such that it can be treated and readily removed once placed in the preselected position, leaving behind the preselected thick film configuration 149. The ability to use the combination media 150 would solve substantial problems associated with constructing complicated lens elements for various electromagnetic field sources which demand highly accurate electromagnetic fields. As an example application the preselected thick film configuration 149 is deposited on the decal 152 by screen printing. The combination media 150 is then fired to remove the decal 152 once the thick film configuration 149 has been placed in the preselected spatial location. The thick film configuration 149 then remains in place in the preselected spatial location. This method of forming the desired electromagnetic field source has important advantages over prior methods, including, (1) a lens stack made using the combination media 150 is automatically aligned by virtue of the careful positioning of the lens element geometry readily located on the decal 152, (2) the number of electrical leads 155 is dramatically reduced since the connections can be patterned integral to the combination media 150 and (3) the cost of manufacture is greatly reduced.

In another form of the invention the general ability to provide predetermined electric field boundary conditions using the preselected thick film configuration 148 has general applications. These applications arise when there is a need for electric field means generating an undistorted electric field potential, particularly near structural anomalies, such as holes and protrusions. Important applications also arise for instances when electric field regions are defined by irregular shapes and in cases where the designer wishes to modify selected portions of an electromagnetic field.

An additional feature of the spectrometer 10 is the application of a coating applied to reduce or minimize effects of using radiation beams in the spectrometer 10. For example, there can be a buildup of excess charge on portions of the spectrometer 10, causing electrostatic anomalies which deflect various charged particles away from desired trajectories and even causing damage preferentially to selected locations. In another form of the invention, coatings can be applied which are particularly resistant to laser beam ionization and are typically used on conductive elements near the sample 12. This type of coating is applied to selected portions of various ones of the lens system elements of the spectrometer 10. Examples of ionization resistant coatings comprise metals which include: Au, Ag, Cu, Pd, Pt, Ru, Sn, Y and Zr. Other materials also can be utilized the reduce detrimental effects and are compatible with the performance specifications of the spectrometer lens system, while performing in accordance with the desired coating requirements. The preferred coating is gold which is applied to the selected lens element to provide protection from interactions with various radiation beams, such as the laser beam pulse 34, the primary radiation beam 14 and any ions, including ions of the selected atomic components.

OTHER MODES OF OPERATION OF THE SPECTROMETER

Because of its unique design, the spectrometer 10 can be operated in a variety of modes, thus making it a versatile instrument for determining surface properties of the sample 12. For example, in the SIMS operating mode, mass spectrometric studies of secondary ions are carried out. Removal of material from the surface of the sample 12 by beams of atoms, ions, electrons or by photon beam bombardment or by fission fragments (plasma desorption mass spectrometry), results in the ejection of a certain fraction of the sample 12 in the form of secondary ions. The spectrometer 10 can be operated in the SIMS mode, leaving the sample 12 at a fixed potential and dispensing with the laser beam pulses 34. Positive and negative secondary ions can be mass analyzed and detected using the electrostatic analyzers 102 and 104 and the associated resistive plate 112.

In another form of the invention the ion spectrometer 10 can be operated selectively in an interleaved, or multiplexed, mode which includes SIMS and neutral atomic component ionization with mass spectroscopy. In this multiplexed mode of operation the selected atomic components are generated in a volume near the sample 12, such as by the primary ion beam 14 striking the sample 12. Using a radiation beam, such as the laser beam pulse 34, neutral ones of the selected atomic components are resonantly or non-resonantly ionized during one cycle and extracted for analysis by EARTOF spectrometry. In a next cycle, secondary ions removed from the sample 12 are extracted for analysis by SIMS.

Depth profiling of the sample 12 can be performed by removal of layers of material, for example, by sputtering or laser ablation, followed by carrying out the neutral atomic component ionization and EARTOF spectroscopy and/or SIMS. The highly efficient and sensitive signal collection ability of this combination system allows a nearly continuous record of chemical makeup as a function of depth in the sample 12. A transition between different matrix materials can be detected by SIMS and impurity levels can be sensed by neutral atomic component resonance or non-resonance ionization with EARTOF spectrometry. Further, due to the typically large dead time between resonance and non resonance atomic component ionization cycles, several SIMS measurements can normally be performed in the interim.

Information obtained from SIMS and from neutral atomic component ionization with EARTOF spectrometry can be complementary in that selected atomic components are preferentially removed as either secondary ions or neutral atomic components, respectively. Consequently, a fuller understanding of the chemical makeup of the sample 12 can be obtained by performing substantially simultaneously both types of spectrometry. The accumulation of both types of spectroscopic information should also allow cross correlation of information and conversion from one information data set to the other, at least in selected instances where complicating effects do not prevent direct comparison. The collection of cross correlation data bases on well characterized standard materials would selectively allow the inference of such complementary information in specimens of partially characterized chemical makeup. For example, the user can perform neutral atomic component non-resonance ionization for examination of all types of neutral components removed from the sample 12, followed by impurity analysis using resonance ionization of selected neutral atomic components and EARTOF spectrometry. Selectively, SIMS can be carried out to evaluate the matrix composition as determined by secondary ions removed from the sample 12. These various sets of results can be compared and contrasted in light of standard data bases to arrive at the chemical makeup of the sample 12.

Figure 10B:
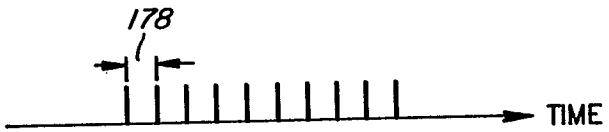

An electronic system 170 for performinig in the multiplexed mode of operation is shown in FIG. 10. Different types of data are generally measured and evaluated by SIMS (intense peaks, analyzed typically by charge integration) compared to ionization of neutral atomic components and performing EARTOF spectometry (generally lower level signals measured by pulse counting techniques). The conventional approach would be to generate a series of electronic gates to collect data associated with the arrival of time of flight ion beam signals, whether the ions are measured in the SIMS mode or the neutral atomic component ionization mode. The numerous gating units necessary to implement this conventional approach would be expensive, and implementation of the decision procedure would necessitate physical transfer of the signal path to new units with attendant problems of loss of time and relative calibration between the units.

In the embodiment of FIG. 10A a conventional transient recorder 172 (such as a TR8828C, manufactured by LeCroy Research Systems Corp. Spring Valley, N.Y.) is used as the final data acquisition hardware for accumulation of time of flight spectra. For measurement of lower level signals, typically associated with the neutral atomic component ionization mode, the input to the transient recorder 172 is passed through a pulse counting means, such as an amplifier 174. Output from the amplifier 174 is a precision pulse 176 having a fixed amplitude 177, and a first output signal with predetermined width 178 is chosen to match the sampling period of the transient recorder 172 (See FIG. 10B).

For measuring the signal associated with the higher current neutral atomic component non-resonance ionization mode of operation, an incoming ion beam signal 179 is amplified by amplifier means, such as a preamplifier 180 and a charge amplifier 182. The analog output from the charge amplifier 182 is an amplified intensity signal input to the transient recorder 172 which directly measures the high level signal. The system 170 therefore switches selectively (using conventional switching logic) between a direct input to the transient recorder 172 and an input through the pulse counting amplifier 174. Such an arrangement enables substantially simultaneous SIMS and neutral atomic component ionization along with EARTOF measurements of atomic components removed from the sample 12 using a radiation beam. This method avoids signal drift associated with rapidly changing chemical makeup of the sample 12. Furthermore, the distribution of atomic components measured by the two methods for the same chemical environment differ due to the different relative production rates among the different atomic components. Thus, performing both types of spectroscopy enables a fuller, more accurate determination of the true chemical makeup of the sample 12. In addition, the neutral atomic component ionization mode provides ultra sensitive, narrow depth resolution information, whlie the SIMS mode provides quantitative matrix information. The combination of the two modes therefore provides complete depth information from the surface layer and into the sample 14 during depth profiling measurements.

In another form of the invention the spectrometer 10 is operated in the Ion Scattering Spectroscopy ("ISS") mode, or in combination with SIMS and neutral atomic component ionization with EARTOF spectrometry. The ISS mode is an important method for obtaining surface composition and adsorbate structural information on the sample 12. The design of the spectrometer 10 allows it to be operated as an ISS instrument by taking advantage of the fact that the incoming primary ion beam 14 is directed normal to the sample 12, while the path of ion travel during time of flight measurements is along the third path 90, also normal to the sample 12. In the ISS mode the electrostatic analyzer 102 is switched off while an ion detector 182 (shown in FIG. 1) is activated to detect the ion beam 88 allowed to pass thereto. Back scattered ions from the primary ion beam 14 are energy analyzed in the time of flight portion of the spectrometer by measuring their arrival time at the ion detector 182 in a conventional manner.

In addition to functioning as positive and negative ion energy analyzers, the electrostatic analyzers 102 and 104, along with the resistive plate 112, are adapted generally to function as charged particle analyzers by carrying out electron energy analysis. They can therefore be used for performing general charged particle energy analysis, including energy analysis of Auger, X-ray photoelectron, ultraviolet photoelectron and synchrotron radiation photoelectron spectroscopy. Provisions for appropriate sample illumination devices such as electron guns, X-rays or U.V. photon sources can be made in a conventional manner.

The following examples are merely illustrative of several operating results from the ion spectrometer 10.

EXAMPLE I

The preferred embodiment has been used to perform depth profiling analyses on high purity silicon wafers which had been implanted with $^{56}Fe$ at an energy of 60kV. This chemical system was chosen to illustrate advantages of analysis for the ion spectrometer 10 over conventional SIMS which experiences problems associated with distinguishing between the substantially equivalent masses of the Fe and $Si_2$ dimer species. Both of these atomic components appear at the nominal mass fifty-six position.

In the measurements cited herein the Fe concentration at the peak of the concentration profile versus depth was reliably estimated at 400 ppb through the use of standard ion implantation range data. Based on that calibration, the following data were measured in the spectrometer 10 using the operating parameters of the preferred embodiment set forth in the specification.

| Principal Results | |
|---|---|
| Sensitivity limit: | <2 ppb $^{56}Fe$ impurity in silicon<br>0.5 ppb for $^{54}Fe$ impurity in silicon |
| Collection efficiency: | About 8% (atoms detected per atom removed from sample |
| **Measurement Parameters** | |
| Ion beam area: | 0.05 $mm^2$ |
| Ion beam current: | 2 μA |
| Ion beam energy: | 5k V |
| Measurement time: | 1000 seconds |
| Monolayers removed: | 0.86 |
| Signal/noise: | 1 |
| Raster area: | 4 $mm^2$ |

EXAMPLE II

The ion spectrometer 10 was operated in a non-resonant mode using a two microamp argon ion beam for the primary ion beam 14 which was pulsed once for 500ns. The spectrometer 10 was operated using the working parameters of the preferred embodiment set forth in the specification. The sample 12 was metallurgical grade molybdenum, and the neutral isotype composition is set forth below and should be compared to the measured spectrum illustrated in FIG. 8.

| Isotype | Percentage Natural Abundance |
|---|---|
| $Mo^{92}$ | 15.84 |
| $Mo^{94}$ | 9.04 |
| $Mo^{95}$ | 15.72 |
| $Mo^{96}$ | 16.53 |
| $Mo^{97}$ | 9.46 |
| $Mo^{98}$ | 23.78 |
| $Mo^{100}$ | 9.13 |

While preferred embodiments of the present invention have been illustrated and described, it will be understood that changes and modifications can be made therein without departing from the invention in its broader aspects. Various features of the invention are defined in the folowing claims.

What is claimed is:

1. A method for quantitative spectroscopic analysis of a sample using a spectrometer to measure the quantity of a selected atomic component removed from said sample by laser beam bombardment, comprising the steps of:

bombarding for a preselected short time period less than about twenty picoseconds said sample with said laser beam and generating a volume near said sample containing said selected atomic component, said short time period calculated to substantially avoid further excitation by said laser beam of said selected atomic component generated in said volume;

applying at least one radiation beam pulse to said atomic component volume for achieving ionization of said selected atomic component;

extracting said ionized selected atomic component from said volume near said sample; and detecting said extracted selected atomic component to determine the relative quantity of said selected atomic component in said sample.

2. The method as defined in claim 1 wherein said laser beam bombardment is performed at selected particular orientations relative to the surface of said sample.

3. The method as defined in claim 1 wherein the power in said laser beam bombardment is selectively controlled.

4. A method of performing efficient quantitative time of flight spectroscopic analysis of atomic components removed from a sample, comprising the steps of:

(a) generating near said sample a volume containing said selected atomic component;

(b) ionizing resonantly selected neutral ones of said selected atomic components in said volume during one cycle of said method and in the next cycle nonresonantly ionizing neutral ones of said selected atomic components in said volume;

(c) extracting said ionized selected atomic components for said time of flight quantitative spectroscopic analysis;

(d) analyzing said extracted selected atomic components; and (e) continuing said method of analysis of steps (a)–(d) until completion of said quantitative, time of flight spectroscopic analysis of said resonantly ionized and said nonresonantly ionized selected atomic components removed from said sample.

5. A method of performing quantitative time of flight spectroscopic analysis of atomic components removed from a sample using radiation, comprising the steps of:

irradiating said sample with said radiation and generating a volume containing secondary ion and neutral forms of said atomic components;

ionizing selectively said neutral form of said atomic components during one cycle of the method and extracting said ionized form of said neutral atomic components for one type of said quantitative time of flight spectroscopic analysis;

extracting said secondary ion form of said atomic components during another cycle of the method for performing another type of said quantitative time of flight spectroscopic analysis; and analyzing said ionized form of said neutral atomic components during said one type of quantitative time of flight spectroscopic analysis and analyzing said secondary ion form of said atomic components during said another type of quantitative time of flight spectroscopic analysis; and sensing said analyzed atomic components for performing said quantitative time of flight spectroscopic analysis.

6. A method for performing quantitative spectroscopic analysis of atomic components at selected depths in a sample using selected radiation beams to remove from said sample neutral and secondary ion forms of said atomic components, comprising the steps of:

(a) irradiating said sample using one of said selected radiation beams to remvoe said atomic components from said sample for said quantitative time of flight spectroscopic analysis;

(b) ionizing said neutral forms of said atomic components removed from said sample by said selected radiation beam, said step of ionizing selectively performed resonantly or nonresonantly using one of said radiation beams;

(c) extracting selectively during a first cycle said ionized neutral forms of said atomic components and during a subsequent cycle extracting said secondary ion forms of said atomic components removed from said sample by said selected radiation beam;

(d) performing said quantitative time of flight spectroscopic analysis of said extracted atomic components; and (e) selectively removing material from said sample to said selected depth using one of said selected radiation beams and performing steps (a)–(d) until completion of said time of flight spectroscopic analysis.

7. The method as defined in claim 6 further including the step of comparing and correlating the analyzed quantity of said atomic component at said selected depth determined from said ionized and extracted neutral form of said atomic components and said secondary ion form of said atomic components removed from said sample.

8. An apparatus for performing different types of quantitative time of flight spectroscopic analysis of atomic components removed from a sample using a radiation beam, comprising:

means for irradiating said sample with said radiation beam generating a volume containing secondary ion and neutral forms of said atomic components;

means for ionizing selectively said neutral forms of said atomic components during one cycle of operation of said apparatus and extracting said ionized neutral form of said atomic component to perform one of said types of quantitative time of flight spectroscopic analysis;

means for extracting said secondary ion form of said atomic component during another cycle of operation of said apparatus to perform another of said types of quantitative time of flight spectroscopic analysis;

means responsive to said extracted atomic components for sensing said extracted atomic components and generating an intensity signal associated with said different types of quantitative time of flight spectroscopic analysis;

amplifier means responsive to said intensity signal for generating an amplified intensity signal for performing one of said different types of quantitative time of flight specrtroscopic analysis;

pulse counting means, responsive to said amplified intensity signal associated with said ionized neutral form of said atomic component, for generating a first output signal having a predetermined time width; and a transient recorder for switching between the output of said pulse counting means and said amplifier means, said first output signal from said pulse counting means processed by said transient recorder to perform said quantitative time of flight spectroscopic analysis associated with said ionized neutral form of said atomic component and said amplified intensity signal input directly to said transient recorder processed by said transient recorder to perform said quantitative time of flight spectroscopic analysis associated with said secondary ion form of said atomic component.

9. A method for quantitative spectroscopic analysis of a sample using a spectrometer to measure the quantity of a selected atomic component removed from said sample by laser beam bombardment, comprising the steps of:

bombarding for a preselected short time period less than about twenty picoseconds said sample with said laser beam and generating a volume near said sample containing said selected atomic component, said short time period calculated to substantially avoid forming a plasma state of said selected atomic component generated by said laser beam;

applying at least one radiation beam pulse to said atomic component volume for achieving ionization of said selected atomic components;

extracting said ionized atomic compnent from said volume nearest said sample; and detecting said extracted selected atomic component to determine the relative quantity of said selected atomic component in said sample.

10. A method for quantitative spectroscopic analysis of a sample using a spectrometer to measure the quantity of a selected atomic component removed from said sample by laser beam bombardment, comprising the steps of:

bombarding for a preselected short time period less than about twenty picoseconds said sample with said laser beam and generating a volume near said sample containing said selected atomic pump component, said short time period calculated to form a narrow energy spread of said selected atomic component by substantially avoiding further excitation by said laser beam of said selected atomic component generated in said volumes;

applying at least one radiation beam pulse to said atomic component volume for achieving ionization of said selected atomic components;

extracting said ionized atomic component from said volume nearest said sample; and detecting said extracted selected atomic component to determine the relative quantity of said selected atomic component in said sample.

11. A method for quantitative spectroscopic analysis of a sample using a spectrometer to measure the quantity of a selected atomic component removed from said sample by laser beam bombardment, comprising the steps of:

bombarding for a preselected short time period less than about twenty picoseconds said sample with said laser beam and generating a volume near said sample containing said selected atomic component, said short time period calculated to form a dimensionally small melted region on said sample and generating said selected atomic component from said small melted region, enabling high special resolution analysis of said sample;

applying at least one radiation beam pulse to said atomic component volume for achieving ionization of said selected atomic components;

extracting said ionized atomic component from said volume nearest said sample; and detecting said extracted selected atomic component to determine the relative quantity of said selected atomic component in said sample.

* * * * *